US006102217A

United States Patent [19]

Mathy et al.

[11] Patent Number: 6,102,217

[45] Date of Patent: Aug. 15, 2000

[54] MODULAR WALL SHELVING

[76] Inventors: Stephen J. Mathy, 11590 E. Wabash River Hill Dr.; Michael S. Mathy, 505 E. St. Louis Ave., both of Effingham, Ill. 62401

[21] Appl. No.: 09/327,076

[22] Filed: Jun. 7, 1999

[51] Int. Cl.[7] ..... A47F 5/00

[52] U.S. Cl. ..... 211/85.7; 211/70.8; 211/188; 211/194; 211/90.04

[58] Field of Search ..... 211/188, 126.2, 211/194, 64, 70.8, 70.6, 90.01, 90.02, 90.04, 88.01, 85.7; 108/42, 91; 312/242, 245

[56] References Cited

U.S. PATENT DOCUMENTS

| | | | |
|---|---|---|---|
| 2,216,621 | 10/1940 | Mackinga | 211/90.04 |
| 2,536,059 | 1/1951 | Igler | 211/90.04 |
| 2,849,123 | 8/1958 | Magill | 211/90 |
| 3,004,815 | 10/1961 | O'Kain et al. | 312/242 |
| 3,095,249 | 6/1963 | Albrecht | 312/242 |
| 3,259,269 | 7/1966 | Asenbauer | 211/126.2 X |
| 3,451,362 | 6/1969 | Ostling et al. | 211/90.01 X |
| 3,634,983 | 1/1972 | Welch | 211/90.01 X |
| 3,862,689 | 1/1975 | Taub | 211/126.2 |
| 4,074,635 | 2/1978 | Stauble | 108/27 |
| 4,076,350 | 2/1978 | Crist | 312/242 |
| 4,228,743 | 10/1980 | Crook | 108/91 X |
| 4,294,498 | 10/1981 | Van Luit | 312/245 |
| 4,632,412 | 12/1986 | Nasqowitz | 211/188 X |
| 4,681,380 | 7/1987 | Carlin | 312/242 |
| 4,909,158 | 3/1990 | Sorensen | 108/40 |
| 5,054,625 | 10/1991 | Foley | 211/85.7 |
| 5,211,292 | 5/1993 | Paolucci | 211/40 |
| 5,427,446 | 6/1995 | Glomski | 312/242 |
| 5,484,196 | 1/1996 | Kim | 312/242 |
| 5,617,797 | 4/1997 | Casey | 108/42 |

*Primary Examiner*—Robert W. Gibson, Jr.
*Attorney, Agent, or Firm*—Grace J. Fishel

[57] ABSTRACT

A stackable wall shelving module adapted to fit between wall studs and sit on a soleplate. Modules may be stacked one upon the other, from the floor to the ceiling if desired. The module has side walls, a horizontal support at a right angle to the side walls and a back wall attached to a rear edge of the side walls and the horizontal support. A horizontal member is attached to the side walls at a front edge of the horizontal support to serve as a railing.

6 Claims, 4 Drawing Sheets

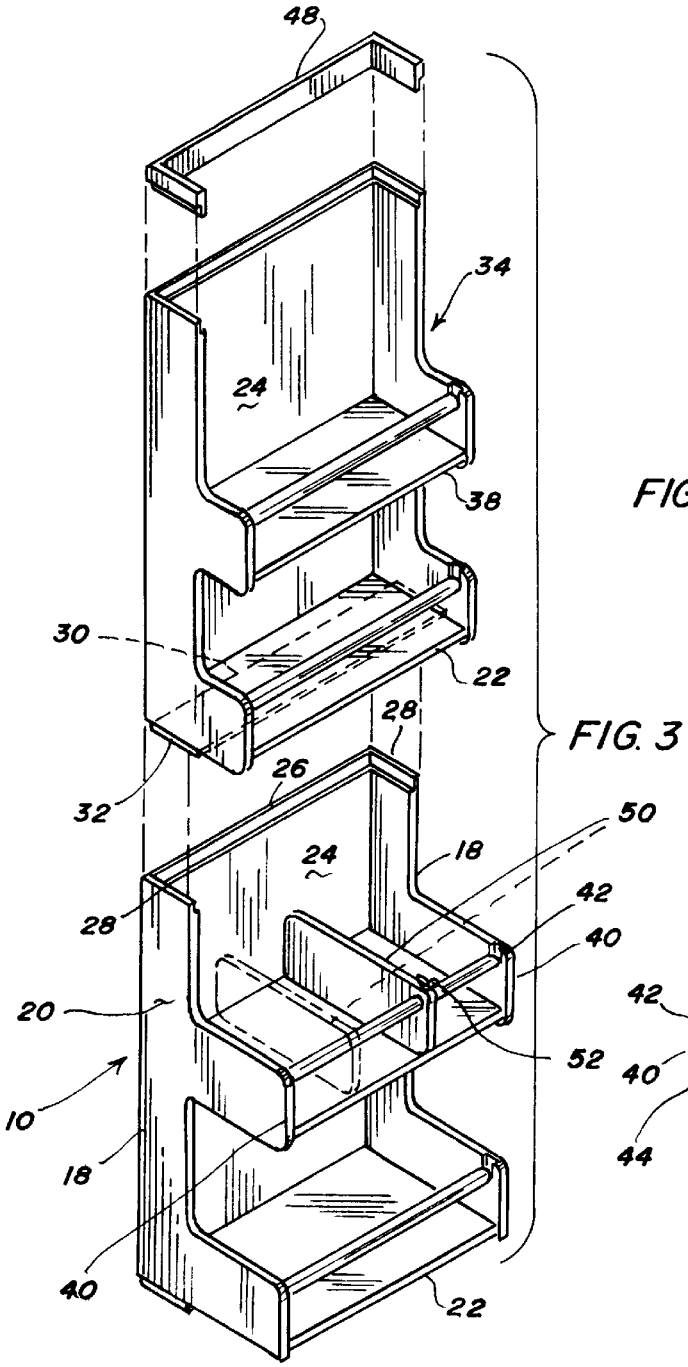
FIG. 3
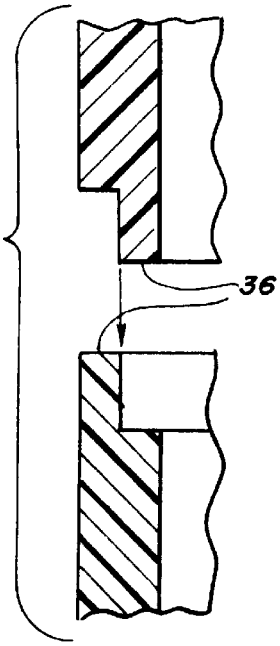
FIG. 4
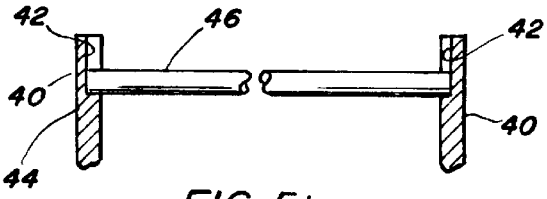
FIG. 5b
FIG. 5a
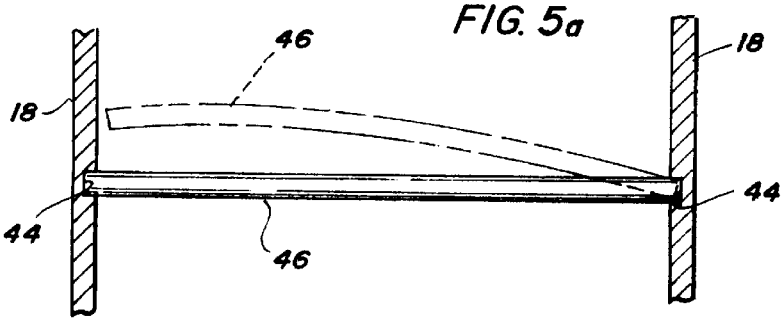

MODULAR WALL SHELVING

BACKGROUND OF THE INVENTION

1. Field of the Invention

The present invention relates to a wall shelving module adapted to fit between wall studs, provided in various depths, simple to install and durable.

2. Brief Description of the Prior Art

Most residential homes built since about 1950 have inside walls made of sheetrock or other similar material and wall supports consisting of wood or metal studs extending vertically between the inner sheetrock wall and outer wall. The studs are spaced apart 16 inches center to center, are about 2 inches thick and about 4½ inches in depth. In unfinished garages, basements, attics and the like, the space between the studs has been used to store cans, odd shaped boxes, and other miscellaneous items, which storage detracts from the area's appearance. There are shelves designed to fit between the studs but they are difficult to install and are not deep enough to be practical.

Sports, lawn, garden, automotive, household maintenance and other equipment is typically stored and accumulates in garages and other unfinished areas. In fact, it is sometimes difficult to walk across the floor in an unfinished area without tripping over basketballs, bike helmets, in-line skates, golf shoes, etc. There are free-standing shelves that can be placed in front of the studs but objects are often pushed off the back of the shelf into the gap between the studs.

Many of the prior art shelves, attached or free-standing, in addition to being difficult to install, too narrow or allowing things to drop off the back are relatively expensive or are made of metal that is subject to corrosion or rusting.

The present invention overcomes the disadvantages discussed. The shelving is made of a durable material that does not rust or corrode, is easy to install, extends beyond the front edges of the stud and has a closed back. The depth of the shelving can be greater than the depth of the studs, making the shelves much more functional. Even more important, a bottom unit can be simply installed between the studs upon the soleplate of the wall, with additional units stacked one upon the other, from the floor to the ceiling, if desired. The free-standing stacked unit can then be attached to the studs as more particularly described below.

BRIEF SUMMARY OF THE INVENTION

In view of the above, it is an object of the present invention to provide a highly functional wall shelving unit adapted to fit between wall studs. It is another object to provide a wall shelving unit that is easy to install. It is also an object to provide a wall shelving unit that is durable and does not corrode or rust. Other objects and features of the invention will be in part apparent and in part pointed out hereinafter.

In accordance with the invention, a wall shelving module is formed of a durable material that does not rust or corrode and is adapted to fit horizontally between two wall forming studs and to sit upon a soleplate. The module has a pair of spaced parallel side walls and a horizontal support at substantially a right angle to the side walls, cross-linking the side walls and forming a shelf. There is a back wall attached to a rear edge of the side walls and the horizontal support. The back wall has a top edge substantially parallel to the horizontal support and co-planar with a top edge of the side walls. The back wall also has a bottom edge substantially parallel to the horizontal support and co-planar with a bottom edge of the side walls, each top edge of the back and the side walls is adapted to matingly edge-join a bottom edge of the back and the side walls of a second vertically stacked module.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which:

FIG. 3 is an exploded, perspective view of the stacked wall shelving modules shown in FIG. 2;

FIG. 4 is an exploded, side view in cross-section, taken along line 4—4 in FIG. 2 of an edge joint for joining the modules;

FIG. 5*a* is a front view in cross-section showing a removable horizontal member;

FIG. 5*b* is a second front view in cross-section showing another removable horizontal member;

DETAILED DESCRIPTION OF THE INVENTION

Figure 1:
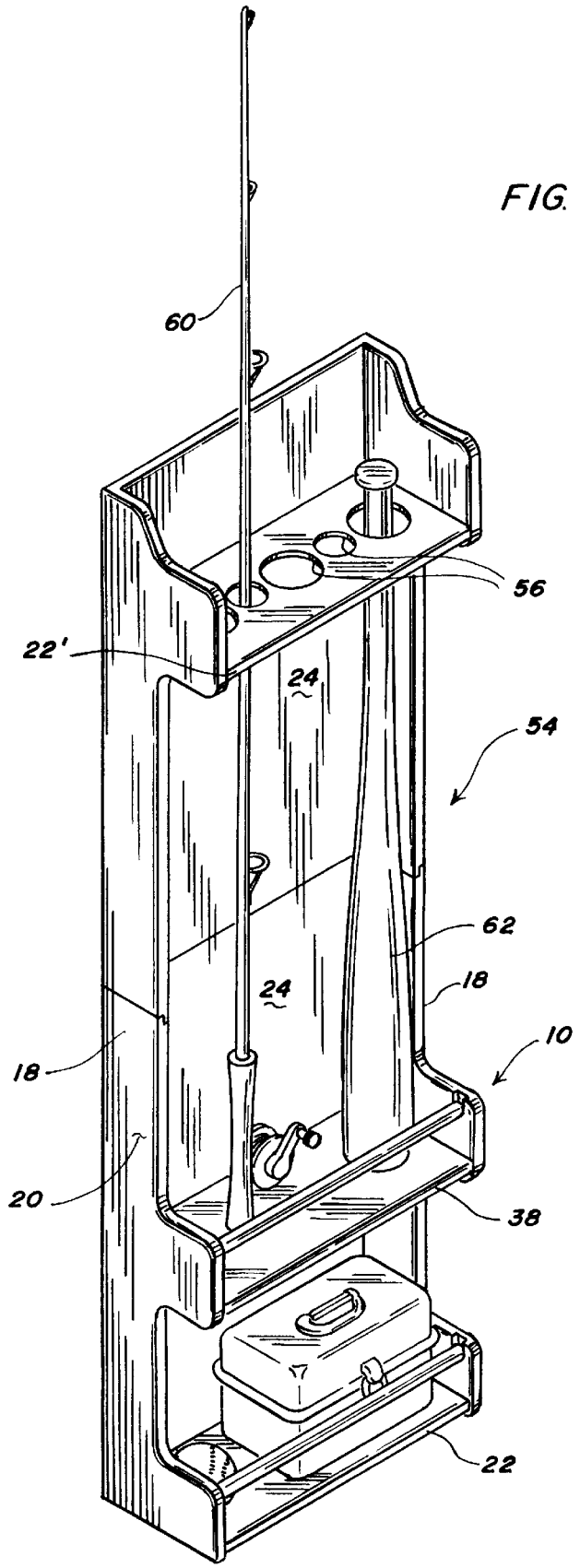
FIG. 1 is a perspective view of a pair of stacked wall shelving modules in accordance with the present invention.

Referring to the drawings more particularly by reference character, reference numeral 10 refers to a wall shelving module in accordance with the present invention. Module 10 is preferably formed of a durable material that does not rust or corrode, such as wood, particle board, plastic or the like. A preferred material is plastic such as polystyrene, ABS, polyethylene and so forth. The particular plastics mentioned above are set forth by way of illustration, not limitation, as other suitable materials may now or later be identified.

Walls 12 formed of vertical supports or studs 14 include a soleplate 16 upon which the vertical studs 14 butt. In most residential homes, the studs are 2×4 boards, but in commercial construction they can be larger, such as 2×6's or 2×8's. The vertical supports 14 can be made of steel or other metal and otherwise resemble their wooden counterparts. Typically, studs 14 are spaced apart about 16 inches, center to center. The space between studs 14 is available for storage from the floor to the ceiling provided the space is not obstructed with wires or pipes.

Module 10 comprises a pair of spaced parallel side walls 18, the outside faces 20 of which are so spaced that module 10 is adapted to fit horizontally between two studs 14, with the outside faces in abutment with the studs. A horizontal support 22, near the bottom and serving as a bottom shelf, is provided at substantially a right angle to side walls 18. A back wall 24 is attached to a rear edge of side walls 18 and bottom shelf 22.

Figure 2:
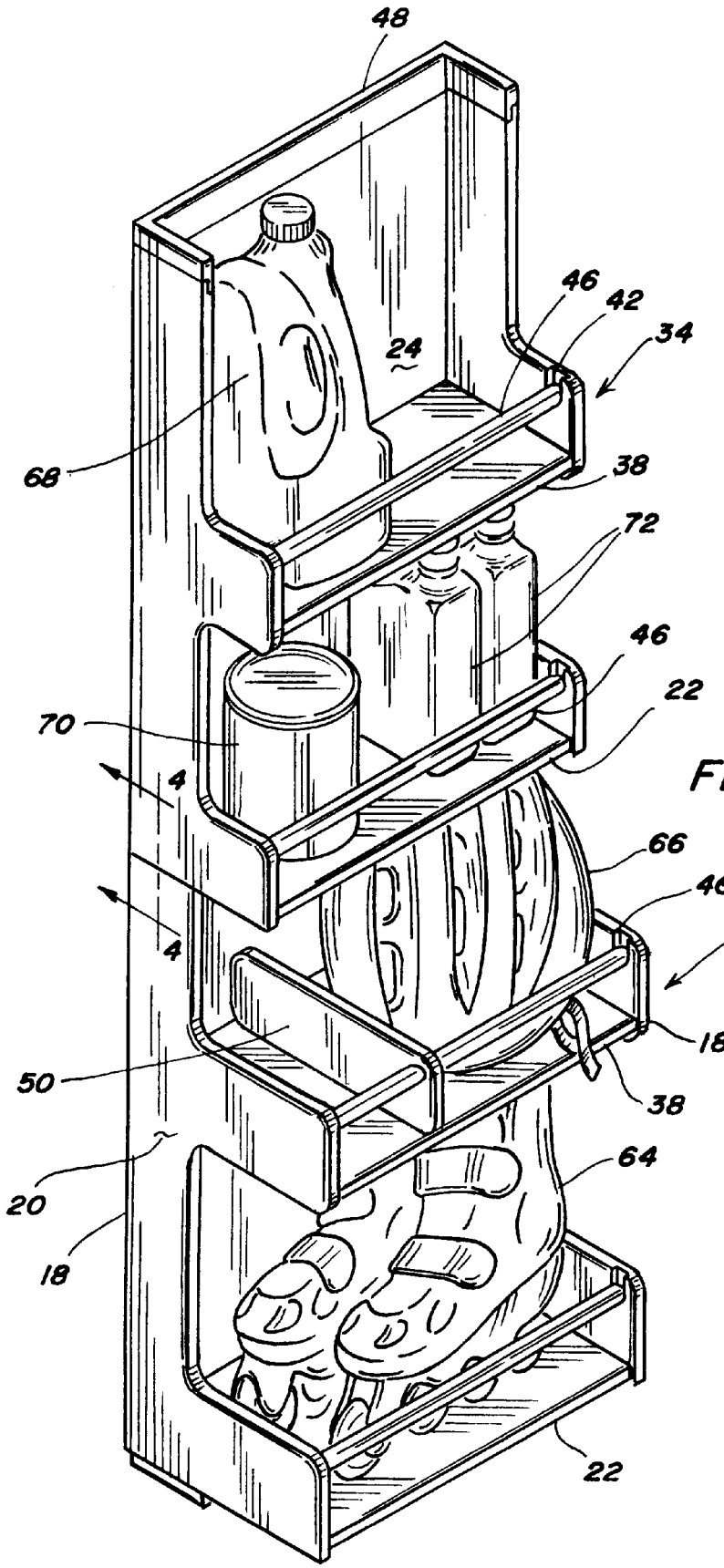
FIG. 2 is a perspective view of a second pair of stacked wall shelving modules in accordance with the present invention.
Figure 6:
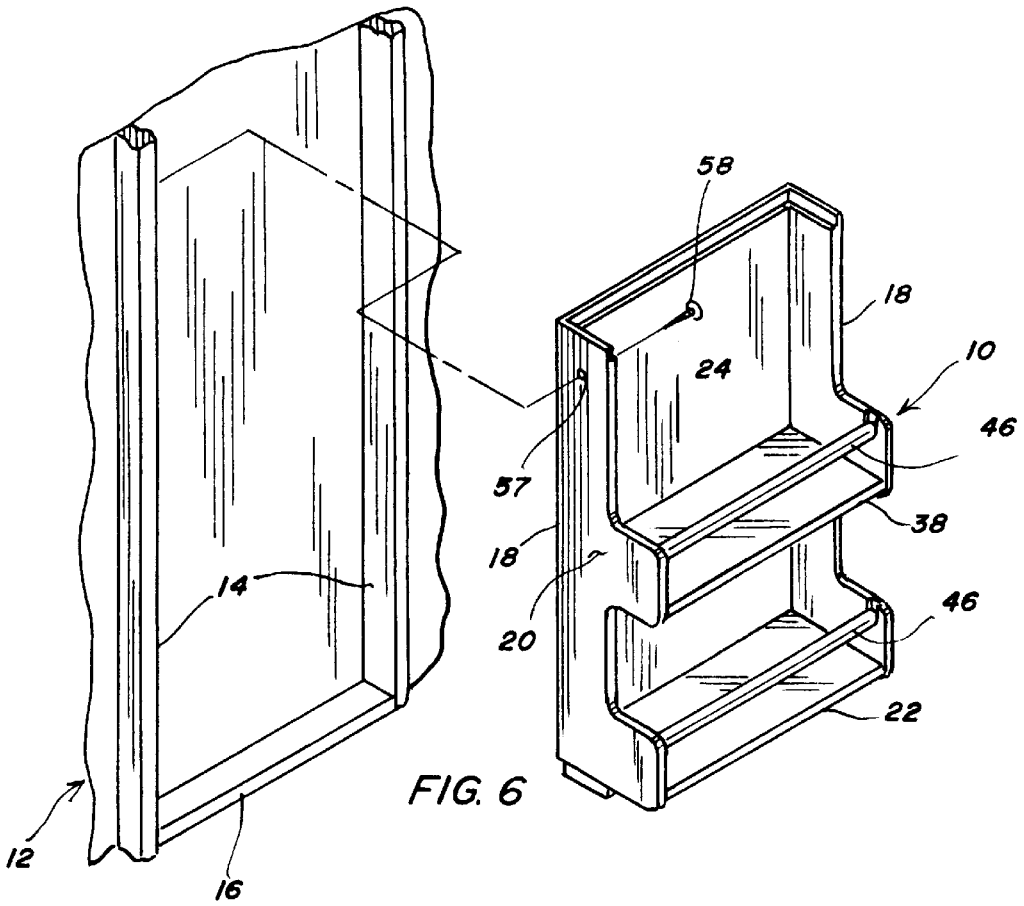
FIG. 6 is an exploded, perspective view of the module being installed in a wall between studs and on a soleplate; and, FIG. 7 is an exploded, perspective view of the module being installed on a finished wall.

Back wall 24 has a top edge 26 substantially parallel to bottom shelf 22 and co-planar with a top edge 28 of side walls 18. Back wall 24 also has a bottom edge 30 which is substantially parallel to bottom shelf 22 and co-planar with a bottom edge 32 of side walls 18. In the form shown in the drawings, first or bottom module 10 may sit on bottom edges 30, 32 on soleplate 16. As illustrated in FIGS. 2–3, top edge 26 of back wall 24 and top edges 28 of side walls 18 are adapted to matingly edge-join bottom edge 30 of back wall and bottom edge 32 of side walls, respectively, of a second module 34 stacked vertically on top of first module 10. As shown in FIG. 4, top edges 26, 28 and bottom edges 30, 32 may have correspondingly formed rabbets 36 by means of which they are matingly edge-joined in the manner of a shiplap. It will be understood, however, that other means of edge-joining the modules may also be used, including other joints or appropriate clips.

With continuing reference to FIGS. 2 and 3, both of modules 10, 34 have at least one additional support 38 serving as another shelf attached to side walls 18 and back wall 24 substantially parallel to and spaced above first horizontal support or shelf 22. Side walls 18 are preferably L-shaped above first support 22 and second support 38 so that an object on the first and second supports can overhang the side walls 18. Additionally, a foot 40 of the L-shaped portion may have a pair of opposing vertical channels 42 opening from a top edge of the foot. As shown in FIG. 5*b*, opposing channels 42 receive a horizontal member 46, such as a rod or the like, forming a railing along the front edge of first and second horizontal supports 22, 38 to confine objects placed thereon. In other embodiments of module 10, as shown in FIG. 5*a*, horizontal member 46 may be bendable for receipt in opposing recesses 44, in which case side walls 18 need not be L-shaped. Top edges 26, 28 of second module 34 may be finished with a trim strip 48 which is matingly edge joined in a comparable manner.

A divider 50 may be strung on horizontal member 46 with a set screw 52 for locking it in a selected position. Divider 50 may be a rectangular plate with an aperture through which horizontal member 46 passes.

In the embodiment illustrated in FIG. 1, a third module 54 is mounted over first module 10. Third module 54 is similar to first and second modules 10, 34 except that horizontal support 22' is near the top and serves as a top shelf. As shown in FIG. 1, horizontal support 22' may be provided with a plurality of apertures 56 through which taller items can extend.

Figure 7:
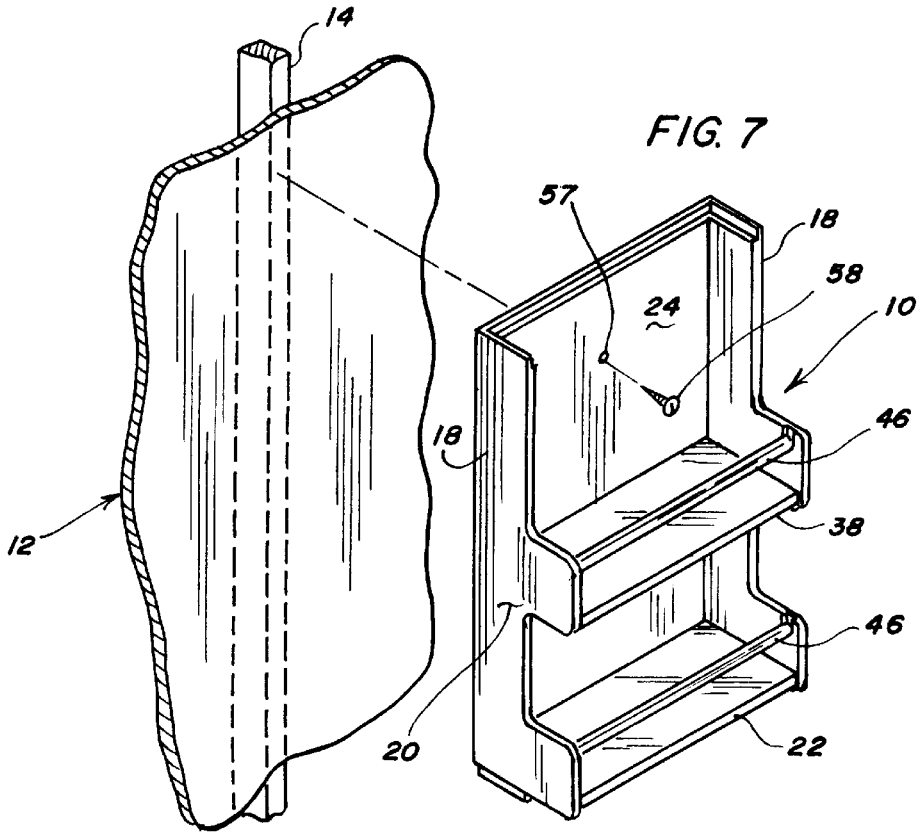

In use, first module 10 may be placed upon soleplate 16 with side walls 18 flush against vertical studs 14. Second module 34, which may the same or different from first module 10, is then stacked on first module 10 and edge joined as discussed above. Another module may then be stacked upon the second module 34 and so forth, from the floor to the ceiling if desired. The unit is free standing during assembly, however, before the shelves are loaded with equipment, side walls 18 of each module are preferably attached to the studs. For this purpose, side walls 18 may be provided with guide bores 57 through which an appropriate fastener 58 such as a screw or a finishing nail can be driven into studs 14 to securely attach the modules to the studs. It will also be understood that first module 10 does not have to sit upon soleplate 16 and that it may be hung between the studs, or if the wall is finished as shown in FIG. 7, module 10 may be attached to stud 14 with a fastener 58 passing through back wall 24.

As will be apparent from the drawings, different modules may be provided in different depths and in different styles depending on the nature of the equipment to be stored. For example, in FIG. 1, a fishing pole 60 and a baseball bat 62 are shown resting on second horizontal support 38 of first module 10 and extending through apertures 56 in third module 54 mounted above. In FIG. 2, first module 10 is deeper than second module 34 for use in storing such bulky items as a pair of in-line skates 64 and a helmet 66. Divider 50 can be used to partition the storage space. Second module 34 is narrower than first module 10 and is designed to store such items as a jug 68 of lawn chemicals, a quart of paint 70, bottles of motor oil 72, etc. Horizontal members 46 keep the items from falling off the shelf, while back wall 24 and side walls 18 confine them on the other sides.

Modules 10, 34 and 54 may be provided in a standard height such that the units may be mixed or matched and a merchant does not have to stock too many different kinds to satisfy the requirements of most purchasers interested in installing wall shelving. Installation is easy and the shelves are not subject to corrosion or rusting.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A wall shelving module formed of a durable material that does not rust or corrode and adapted to fit horizontally between two wall forming studs and to sit upon a soleplate, said module comprising a pair of spaced parallel side walls and a horizontal support at substantially a right angle to the side walls and forming a shelf, a back wall attached to a rear edge of the side walls and the horizontal support, said back wall having a top edge substantially parallel to the horizontal support and co-planar with a top edge of the side walls, said back wall having a bottom edge substantially parallel to the horizontal support and co-planar with a bottom edge of the side walls, each top edge of the back and the side walls adapted to matingly edge-join a bottom edge of the back and the side walls of a second vertically stacked module, said top edge of the back and the side walls of the first module and the bottom edge of the back and the side walls of the second module having correspondingly formed rabbets by means of which they are matingly edge-joined.

2. A wall shelving module formed of a durable material that does not rust or corrode and adapted to fit horizontally between two wall forming studs and to sit upon a soleplate, said module comprising a pair of spaced parallel side walls and a horizontal support at substantially a right angle to the side walls and forming a shelf, a back wall attached to a rear edge of the side walls and the horizontal support, said back wall having a top edge substantially parallel to the horizontal support and co-planar with a top edge of the side walls, said back wall having a bottom edge substantially parallel to the horizontal support and co-planar with a bottom edge of the side walls, each top edge of the back and the side walls adapted to matingly edge-join a bottom edge of the back and the side walls of a second vertically stacked module, said horizontal support being at the bottom edge of the back wall and there being a second horizontal support attached to the side walls and the back wall substantially parallel to the horizontal support and spaced therefrom.

3. A wall shelving module formed of a durable material that does not rust or corrode and adapted to fit horizontally between two wall forming studs and to sit upon a soleplate, said module comprising a pair of spaced parallel side walls and a horizontal support at substantially a right angle to the side walls and forming a shelf, a back wall attached to a rear edge of the side walls and the horizontal support, said back wall having a top edge substantially parallel to the horizontal support and co-planar with a top edge of the side walls, said back wall having a bottom edge substantially parallel to the horizontal support and co-planar with a bottom edge of the side walls, each top edge of the back and the side walls adapted to matingly edge-join a bottom edge of the back and the side walls of a second vertically stacked module, said horizontal support being near the top edge of the back wall.

4. A wall shelving module formed of a durable material that does not rust or corrode and adapted to fit horizontally between two wall forming studs and to sit upon a soleplate, said module comprising a Pair of spaced parallel side walls and a horizontal support at substantially a right angle to the side walls and forming a shelf, a back wall attached to a rear edge of the side walls and the horizontal support, said back wall having a top edae substantially parallel to the horizontal support and co-planar with a top edge of the side walls, said back wall having a bottom edge substantially parallel to the horizontal support and co-planar with a bottom edge of the side walls, each top edge of the back and the side walls adapted to matingly edge-join a bottom edge of the back and the side walls of a second vertically stacked module, said side walls having a recess in each side wall near a front edge of the horizontal support and a horizontal member adapted to be received in the recesses and forming a stop at the front edge of the horizontal support.

5. A wall shelving module formed of a durable material that does not rust or corrode and adapted to fit horizontally between two wall forming studs and to sit upon a soleplate, said module comprising a pair of spaced Parallel side walls and a horizontal support at substantially a right angle to the side walls and forming a shelf, a back wall attached to a rear edae of the side walls and the horizontal support, said back wall having a top edae substantially parallel to the horizontal support and co-planar with a top edge of the side walls, said back wall having a bottom edge substantially parallel to the horizontal support and co-planar with a bottom edge of the side walls, each top edge of the back and the side walls adapted to matingly edge-join a bottom edge of the back and the side walls of a second vertically stacked module, said side walls being indented above the horizontal support and having a substantially vertical channel opening from the indent in each side wall near a front edge of the horizontal support and a horizontal member adapted to be received in the channels and forming a stop at the front edge of the horizontal support.

6. A wall shelving module formed of a durable plastic material and adapted to fit horizontally between two wall forming studs and to sit upon a soleplate, said module comprising a pair of spaced parallel side walls and a horizontal support at substantially a right angle to the side walls and forming a shelf, a horizontal member attached to the side walls at a front edge of the shelf to serve as a railing, a back wall attached to a rear edge of the side walls and the horizontal support, said back wall having a top edge substantially parallel to the horizontal support and co-planar with a top edge of the side walls, said back wall having a bottom edge substantially parallel to the horizontal support and co-planar with a bottom edge of the side walls, each top edge of the back and the side walls adapted to matingly edge-join a bottom edge of the back and the side walls of a second vertically stacked module, said horizontal support being near the top edge of the back wall.

* * * * *